US007812735B2

(12) United States Patent
Kahl et al.

(10) Patent No.: US 7,812,735 B2
(45) Date of Patent: Oct. 12, 2010

(54) METHOD FOR AUTOMATICALLY IDENTIFYING A TYPE OF TRANSPARENT CONVEYOR BELT

(75) Inventors: Dirk Kahl, Preetz (DE); Ralph Petersen, Luetjenburg (DE); Frank Pierel, Gettorf (DE); Soenke Schmidt, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 498 days.

(21) Appl. No.: 11/853,914

(22) Filed: Sep. 12, 2007

(65) Prior Publication Data

US 2008/0061998 A1 Mar. 13, 2008

(30) Foreign Application Priority Data

Sep. 13, 2006 (DE) ..... 10 2006 043 728
Aug. 28, 2007 (DE) ..... 10 2007 040 588

(51) Int. Cl.
*G08B 21/00* (2006.01)
*B41J 2/385* (2006.01)

(52) U.S. Cl. ..... 340/676; 340/673; 340/675; 347/111; 347/114; 347/116

(58) Field of Classification Search ..... None
See application file for complete search history.

(56) References Cited

U.S. PATENT DOCUMENTS 4,847,660 A * 7/1989 Wheatley et al. ..... 399/167
4,967,227 A * 10/1990 Suzuki et al. ..... 355/403
5,291,245 A * 3/1994 Charnitski et al. ..... 399/51
5,574,527 A * 11/1996 Folkins ..... 399/9
5,613,784 A * 3/1997 Ohashi ..... 400/76
5,966,573 A * 10/1999 Yu et al. ..... 399/160
5,995,802 A * 11/1999 Mori et al. ..... 399/394
6,793,302 B2 * 9/2004 Russ ..... 347/4
7,021,738 B2 * 4/2006 Juan et al. ..... 347/19
7,522,849 B2 * 4/2009 Suzuki et al. ..... 399/12
2003/0179271 A1 * 9/2003 Russ ..... 347/104
2006/0228129 A1 10/2006 Yamada
2007/0058992 A1 * 3/2007 Suzuki et al. ..... 399/12

FOREIGN PATENT DOCUMENTS

DE 100 13 982 A1 10/2000
DE 103 18 997 A1 1/2005
EP 1 376 256 A2 1/2004
JP 2001-051518 A 2/2001
JP 2005-195 818 A 7/2005

* cited by examiner

*Primary Examiner*—Julie Lieu
(74) *Attorney, Agent, or Firm*—Robert L. Walker; Peyton C. Watkins

(57) ABSTRACT

In a method for automatically identifying a conveyor belt in a printer as being one of a plurality of belt types, the conveyor belt is moved along a circulatory path. A start and an end of a longitudinal marking on the moving conveyor belt are detected. A distance of travel of the moving conveyor belt between the detecting of the start and the end is sensed to provide a sensed marking length. The sensed marking length is allocated to a nearest of a plurality of nominal marking lengths. Each nominal marking length is associated with a respective one of said belt types. The belt type is associated with or defined by a set of one or more printer control parameters.

18 Claims, 6 Drawing Sheets

METHOD FOR AUTOMATICALLY IDENTIFYING A TYPE OF TRANSPARENT CONVEYOR BELT

This application claims priority from German Patent Application No. 102006043728.4 filed on Sep. 13, 2006, and also claims priority from German Patent Application No. 102007040588.1 filed on Aug. 28, 2007.

FIELD OF THE INVENTION

The invention relates to printing methods, particularly electrophotographic printing methods and more particularly relates to a method for automatically identifying a type of transparent conveyor belt.

BACKGROUND OF THE INVENTION

Circulatory conveyor belts for conveying sheets of material to be printed are generally known in printing technology. Some of these conveyor belts are transparent. This allows detecting and identifying of sheets of print media through the belt. The conveyor belts are generally made of a strip of suitable material joined together at the ends to form an endless belt. The ends are generally laid over one another and welded or adhesively bonded together to form a seam. Since this seam can have an effect upon a printing process in a printing station, it is known to detect the seam and to control a sheet feed such that no sheets to be printed are laid over the seam and sheets are instead positioned a pre-determined distance away from the seam.

It is known to apply a marker to a printer conveyor belt, such as an opaque marker on a transparent belt, the leading edge of which opaque marker is disposed a specific distance away from the seam in the direction of travel of the conveyor belt. The position of the seam is determined by detecting the leading edge of the marker and the sheet feed is controlled on that basis. Furthermore, it is known to determine, and if necessary to correct, a cross-track alignment of the conveyor belt, i.e. at right angles to the direction of travel within the printer, using the marker.

If different types of conveyor belts, which require the use of different control parameters, are used in a printer, it is important to known which conveyor belt is currently being used in the printer. For example, some types of electrophotographic printer can use either coated or uncoated conveyor belts, which have different fuser oil absorption properties. Fuser oil is used in a fuser during fixing of toner images and can be transferred as a contaminant onto the conveyor belt during duplex printing. When conveyor belts having low absorbency are used, it may be necessary to pass blank sheets through the printer at specific intervals of time in order to clean the conveyor belt. When a more strongly absorbent conveyor belt is used, the cycle of passing blank sheets through the printer may be omitted, or the time interval between such cleaning cycles may be extended.

In some prior printers, the type of conveyor belt was manually entered by a machine operator. The printer then looked-up and applied an associated set of control parameters. Manual input presents a risk of error, particularly if the operator is inexperienced.

It would therefore be desirable to provide a method for automatic identification of the type of printer conveyor belt/control parameters in a simple way.

SUMMARY OF THE INVENTION

The invention is defined by the claims. The invention, in broader aspects, provides a method for automatically identifying a conveyor belt in a printer as being one of a plurality of belt types. In the method, the conveyor belt is moved along a circulatory path. A start and an end of a longitudinal marking on the moving conveyor belt are detected. A distance of travel of the moving conveyor belt between the detecting of the start and the end is sensed to provide a sensed marking length. The sensed marking length is allocated to a nearest of a plurality of nominal marking lengths. Each nominal marking length is associated with a respective one of said belt types. The belt type is associated with or defined by a set of one or more printer control parameters.

It is an advantageous effect of the invention that an improved method for automatic identification of the type of printer conveyor belt/control parameters is provided that is simple and relatively robust.

BRIEF DESCRIPTION OF THE DRAWINGS

The above-mentioned and other features and objects of this invention and the manner of attaining them will become more apparent and the invention itself will be better understood by reference to the following description of an embodiment of the invention taken in conjunction with the accompanying figures wherein.

DETAILED DESCRIPTION OF THE INVENTION

Figure 1:
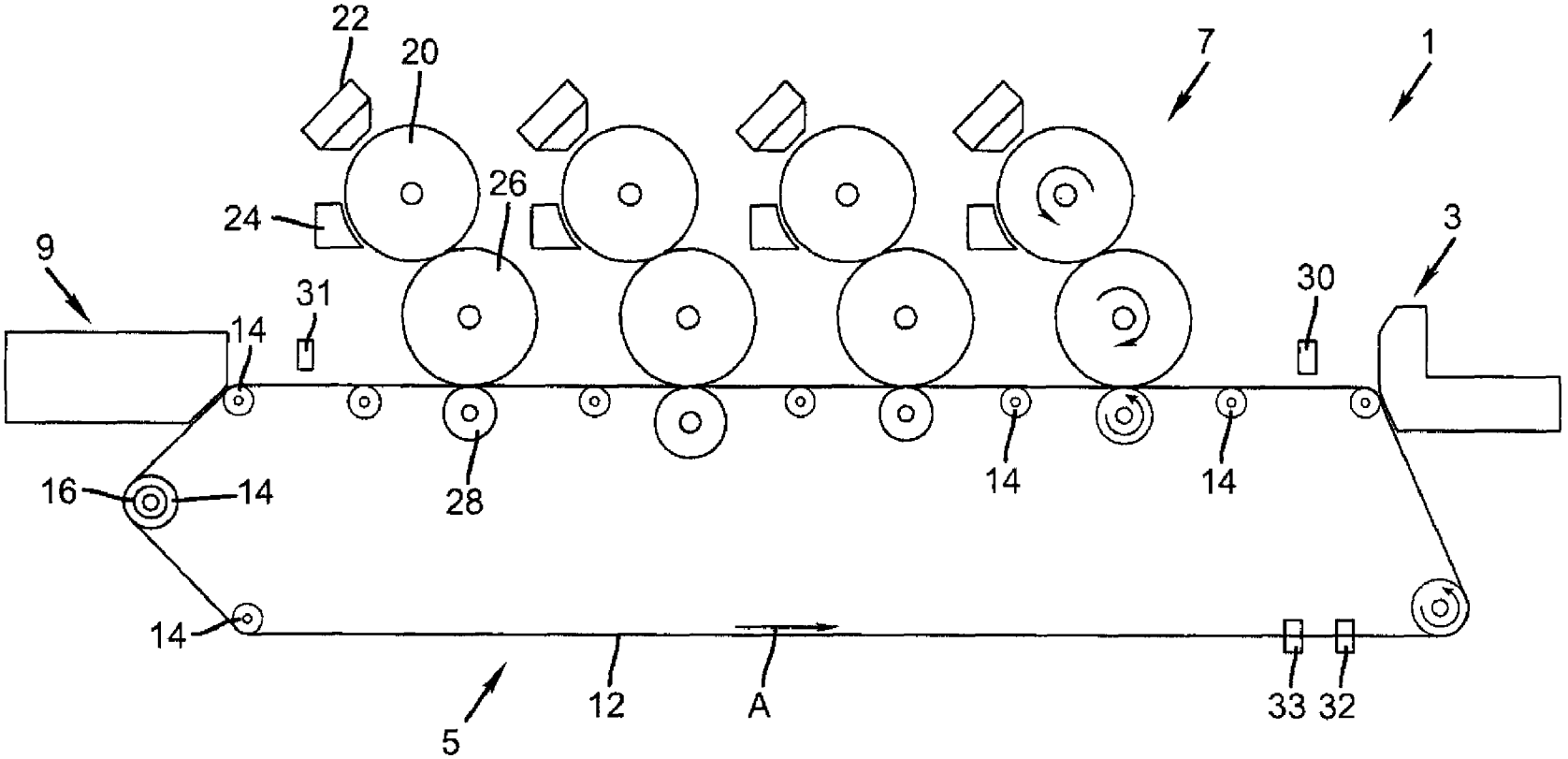
FIG. 1 is a diagrammatic side view of an electrophotographic printer.

The method automatically identifies a conveyor belt in a printer as being one of a plurality of belt types. In a particular embodiment, the belt type is defined by an applicable set of one or more control parameters for the printer. After the type of conveyor belt is automatically identified, appropriate control parameters are applied to the printer. In particular, as described above, sheet feed cycles of the printer can be set in accordance with the type of conveyor belt identified.

In the method, the conveyor belt is moved along a circuit within a printer through one or more printing stations. The conveyor belt is an endless loop and has a longitudinal marking. In a particular embodiment, the conveyor belt has a main portion between a pair of opposed, longitudinal edges. The main portion, which receives the sheets to be printed, is transparent. In this embodiment, the marking is an opaque, longitudinal streak disposed in one of the edges.

A start and an end of a longitudinal marking on the conveyor belt are detected as the conveyor belt is moved. A distance of travel of the moving conveyor belt between detecting the start and the end is then sensed. This distance corresponds to the length of the marking and is also referred to herein as the "sensed marking length". The manner in which the sensed marking length is determined is not critical. For example, the distance of travel can be sensed directly from a timing signal encoder on a roller synchronized with the conveyor belt or the like. Distance of travel can also be sensed indirectly as an elapsed time of travel of the conveyor belt at a known speed.

The sensed marking length is allocated to the nearest of a plurality of nominal marking lengths. Each nominal marking length is associated with a respective one of the belt types. The nominal marking lengths are nominal, that is, each one includes a range of lengths about a "nominal" center value. The ranges can be selected to accommodate expected variations in conveyor belt speed and the like. The ranges are mutually exclusive to prevent ambiguity. The sensed marking length is allocated to a nominal marking length that has a range that is inclusive of the sensed marking length.

The belt type directly provides applicable control parameters for the printer or is used to determine such parameters in a look-up table. The set of control parameters are then applied to the printer.

In a particular embodiment of the invention, in which the conveyor belt is generally transparent and the marking is an elongate streak, a sensor used to detect the start and end of the marking is a light barrier (such as a photocell and a light emitter). This approach has the advantage of simplicity. The light barrier detects the leading and trailing edges of the marking as they pass through the light barrier, blocking or admitting the light from the emitter, respectively. These light barriers are very inexpensive and do not require a high level of measuring precision.

In a particular embodiment of the invention, the conveyor belt has a seam which is spaced a predetermined distance away from the start of the marking in the direction of travel of the conveyor belt. The position of the seam is calculated from the detected start of the marking. It is preferred that the predetermined distance is independent of the type of conveyor belt. In other words, in all of the different types of belts, the distance from the start of the marking to the seam is the same, but the distances between the ends of the different markings and the seam are different. In a particular embodiment, the marking extends over the seam. This allows the start of the marking to be conveniently positioned for indicating the seam location without constraining the length of the marking.

In a particular embodiment, the type of transparent conveyor belt is automatically identified after each re-start of the printer before a printing process is begun. The printer first undergoes a shut-down and then restarts. The restart enables detecting of the start and end of the marking, sensing of the marking length, and the determination of the belt type.

In a particular embodiment, the identification of the conveyor belt is enabled when an access flap is opened. A belt access signal is generated when an access flap of the printer is moved from a closed position to an open position. The access flap denies operator access to the conveyor belt when the access flap is in the closed position and allows operator access only when the access flap is in the open position. This approach has the advantage that the conveyor belt is not identified except when there is a possibility that the belt has been changed. Belt type can otherwise be retained in memory of the printer.

In a particular embodiment, the conveyor belt has an alignment indicator, such as a laterally inward portion of the start of the marking or a separate indicator disposed on the other edge. In this embodiment, after the start of the marking and indicator are detected using sensors, an offset between the start and the indicator is sensed. A cross-track alignment of the conveyor belt relative to the positions of the sensors is computed from the offset. The sensor used to detect the indicator can be a light barrier, as earlier discussed.

The conveyor belt has a side-to-side dimension that defines a cross-track axis that is optimally aligned perpendicular to the direction of travel of the conveyor belt. The longitudinal dimension of the conveyor belt defines a longitudinal axis that is optimally parallel to the direction of travel of the conveyor belt. The start of the marking and the indicator are at known positions in the longitudinal direction. The detection of the start and the detection of the indicator coincide or occur at a predetermined separation. Any further separation is an offset that indicates a cross-track misalignment of the conveyor belt.

In a particular embodiment of the invention, detecting the start of the marking with a first sensor initializes a second sensor that is then used to detect the indicator. The cross-track alignment of the belt is then determined. This allows the second sensor to only be activated, when needed to detect the indicator.

FIG. 1 shows a particular embodiment, in which the printer is an electrophotographic printer 1. The printer 1 has a sheet alignment unit 3, a transport unit 5, a plurality of printing mechanisms 7, and a fixing station 9. Other features, such as sheet feeders and deliverers, and other sheet guide paths, are not shown in detail. These and other features are well known to those of skill in the art. The sheet alignment unit 3 transfers a sheet of media to be printed to the transport unit 5 in an aligned and controlled manner.

The transport unit 5 includes an endless conveyor belt 12 and a plurality of rollers 14, about which the conveyor belt 12 is guided. At least one of the rollers 14 is coupled to a drive unit, which moves the conveyor belt 12 in a circulatory direction as indicated by arrow A. In a particular embodiment, the conveyor belt 12 is wrapped around this driven roller 14 at an angle of at least 90° in order to avoid any slippage between the conveyor belt 12 and the corresponding roller 14. Driven roller 14 has an angular position sensor (also referred to as an encoder) 16, which makes it possible to determine the movement and the position of the conveyor belt 12.

The conveyor belt 12 is guided to move a sheet to be printed through a plurality of printing mechanisms 7. Each of the printing mechanisms 7 has an imaging cylinder 20, a writing device 22, a toner station 24, an intermediate cylinder 26, and an impression cylinder 28. The imaging cylinder 20 has a surface onto which an electrostatically charged image can be applied in a known way by the writing device 22.

When said electrostatically charged image is moved past the toner station 24, toner particles adhere to the electrostatically charged image regions on the surface of the imaging cylinder 20 and are conveyed onwards. The toner particles are then transferred to the respective intermediate cylinder 26, which has a rubber coating. The toner particles are then transferred onto a sheet to be printed located on the conveyor belt 12, the transfer taking place in a nip region between the intermediate cylinder 26 and the impression cylinder 28. In order to facilitate the toner transfer, an electrostatic charge can be generated on the conveyor belt 12 by the impression cylinder 28.

In FIG. 1, four printing mechanisms 7 are shown which are suitable, for example, for applying toner images of different color separations, for example, in the colors cyan, magenta, yellow and black. The printing mechanisms are controlled in a known way so that the color separations are applied in registration over one another on the sheet of media to be printed so as to produce a multi-colored image. A number of printing mechanisms different to that shown in FIG. 1 can also or instead be provided. The respective printing mechanisms 7 can apply the toner images directly onto the media or indirectly via and intermediate element, which then applies the whole toner image to the media to be printed.

The fixing station 9 is disposed downstream of the printing mechanisms 7 and has a fuser that fuses the toner image onto the sheet of media.

In FIG. 1, a plurality of different sensors 30, 31, 32, and 33 are shown. Sensor 30 can, for example, be a sheet identification sensor, which identifies the front edge of a sheet on the conveyor belt 12 during a print job and correspondingly controls the writing device 22 of the printing modules 7. The identification of the sheet by the sensor 30 is, for example, correlated with the data of the angular position sensor 16 in order to provide corresponding control of the writing device 22 of the printing modules 7. The sensor 31 is used in calibration runs of the electrophotographic printer. In such calibration runs, a plurality of index marks, such as at least one toner line for each printing mechanism, are printed onto media or onto the conveyor belt 12, and are then detected by the sensor 31. In this way, the control of the writing devices 22 can be calibrated in a known manner so that images can be printed in registration.

Figure 2:
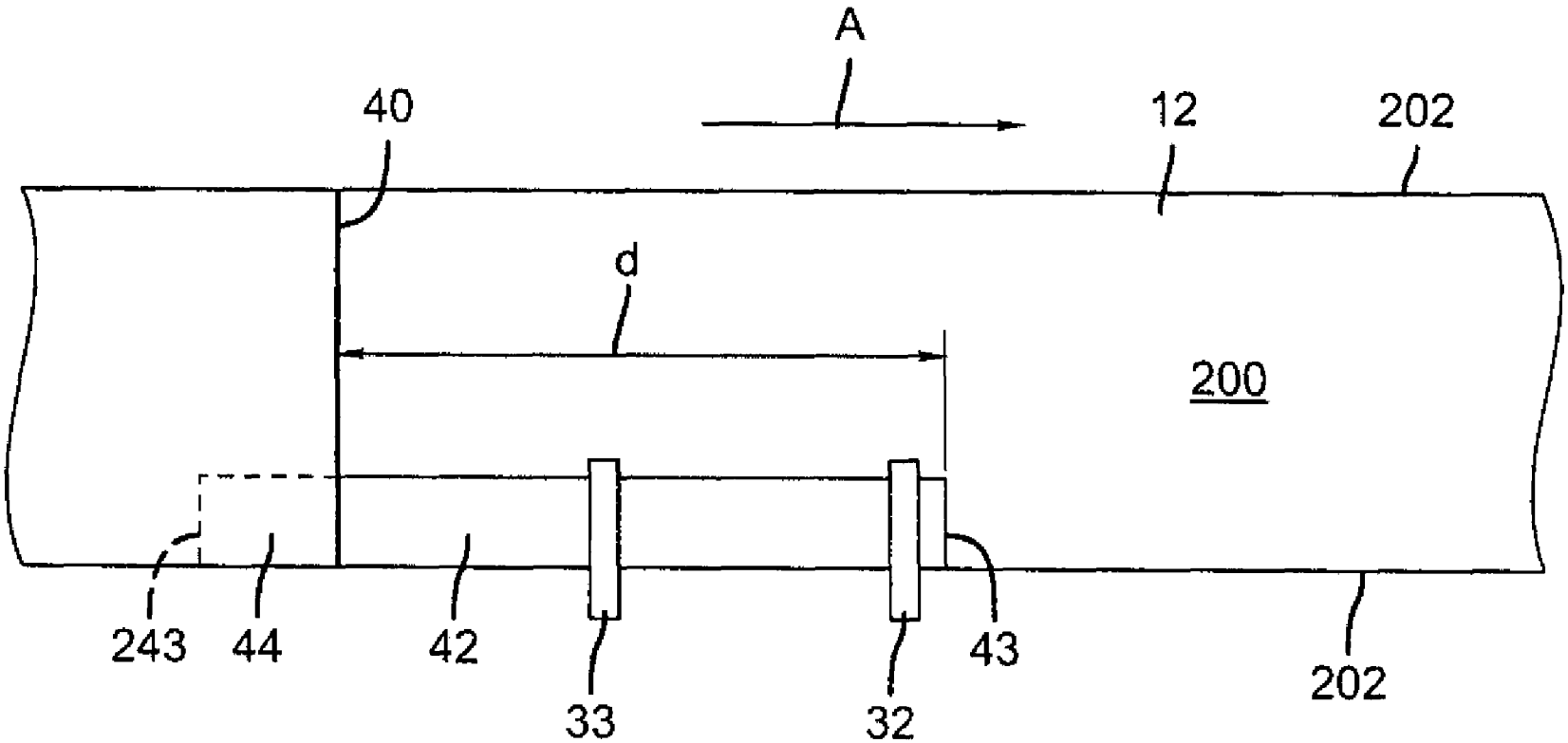
FIG. 2 is a diagrammatic top view of a section of the conveyor belt and sensors of the printer of FIG. 1.
Figure 3:
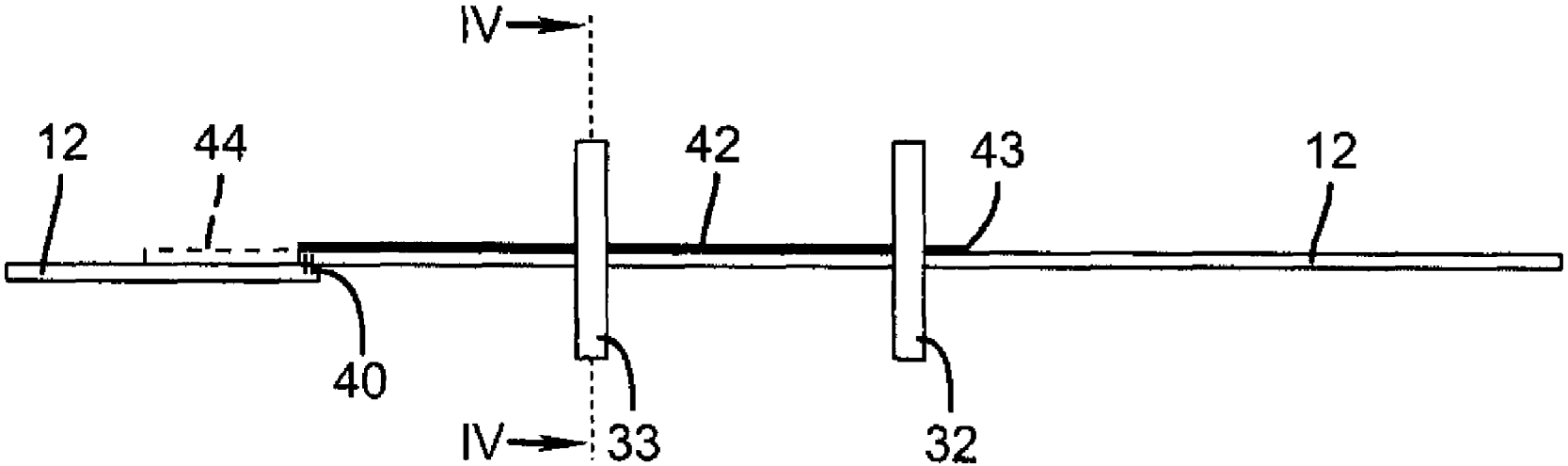
FIG. 3 is a diagrammatic side view of the conveyor and sensors of FIG. 2.
Figure 4:
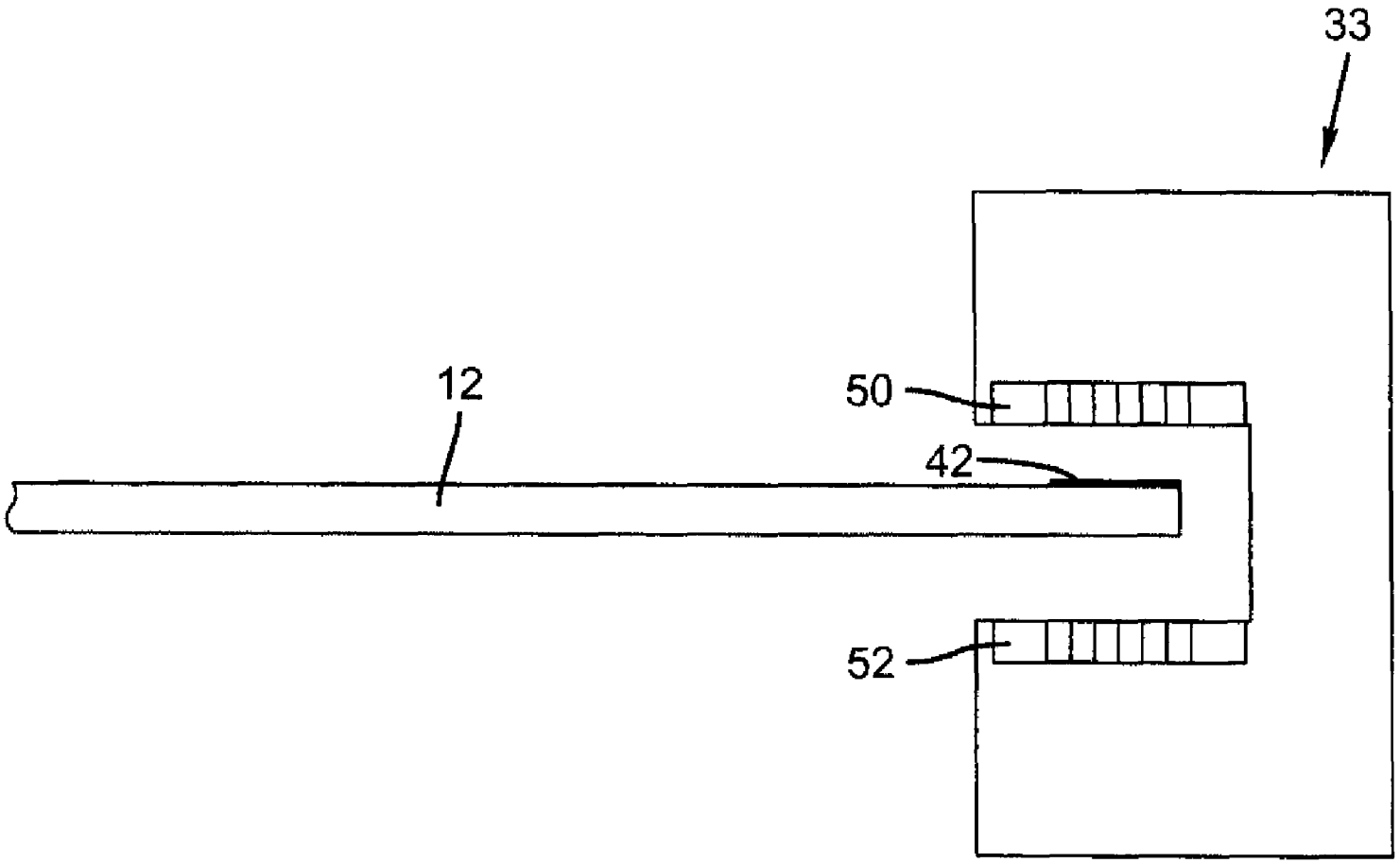
FIG. 4 is an enlarged cross-section view taken substantially along line IV-IV in FIG. 3.

In the following, the operation and the design of the sensors 32 and 33 is described in greater detail with reference to FIGS. 2-4. FIG. 2 shows a diagrammatic top view of a section of the conveyor belt in the region of the sensors 32, 33. FIG. 3 shows a diagrammatic side view of the section of the conveyor belt, and FIG. 4 shows a diagrammatic sectional view along line IV-IV in FIG. 3.

As can be seen in FIGS. 2 and 3, the conveyor belt 12 is a conveyor belt of the previously described type with a seam 40. The seam 40 is formed by adhesively bonding, welding or connecting in some other way overlapping ends of a conveyor belt material. The conveyor belt has a transparent main portion 200 between a pair of opposed longitudinal edges 202.

One side edge 202 of the conveyor belt 12 has a marking 42, in the form of an opaque streak. The front edge or start 43 of the marking 42 is a pre-determined distance 'd' from the seam 40 in the direction of travel. The marking 42 has an overall length dependent upon the type of conveyor belt 12 which can extend, dependently upon belt type, over the seam 40, as shown by the dashed region 44 to a rear edge or end 243. In a particular embodiment, the overall length of the marking 42 and the distance 'd' between the leading edge 43 and the seam 40 always remains the same.

The sensor 32 is disposed downstream in relation to the sensor 33 in the direction of travel A of the conveyor belt 12. Both sensors 32, 33 encompass the conveyor belt 12 on the side on which the marking 42 is provided. This is shown diagrammatically for the sensor 33 in FIG. 4.

The sensor 32 has a light emitter, which directs a beam of light through the conveyor belt 12 onto a corresponding detector. Since the conveyor belt 12 is transparent, the beam of light can normally be detected by the detector. When the opaque marking 42 enters the path of the beam between the emitter and the detector, the detector is shaded and a corresponding start signal is emitted. When the marking emerges again from the path of the beam, the beam of light hits the detector again and a corresponding end signal can be emitted. The sensor 32 is therefore capable of identifying both the front edge 43 and rear edge 243 of the marking by corresponding light/dark and dark/light transitions.

The sensor 33 can be in the form of a so-called line sensor, which has a linearly arranged plurality of light emitters (indicated by 50) and a linear arrangement of light detectors (indicated by 52). In this case, the width of the marking, in a cross-track direction, is broadened. If the start of the marking 42 on the conveyor belt 12 now comes into the region of the sensor 33, a larger or smaller proportion of detectors 52 in relation to emitters 50 is shadowed in accordance with a cross-track position of the conveyor belt 12. This enables the cross-track position of the conveyor belt to be determined and thus corrected by appropriate adjustment means.

Figure 5:
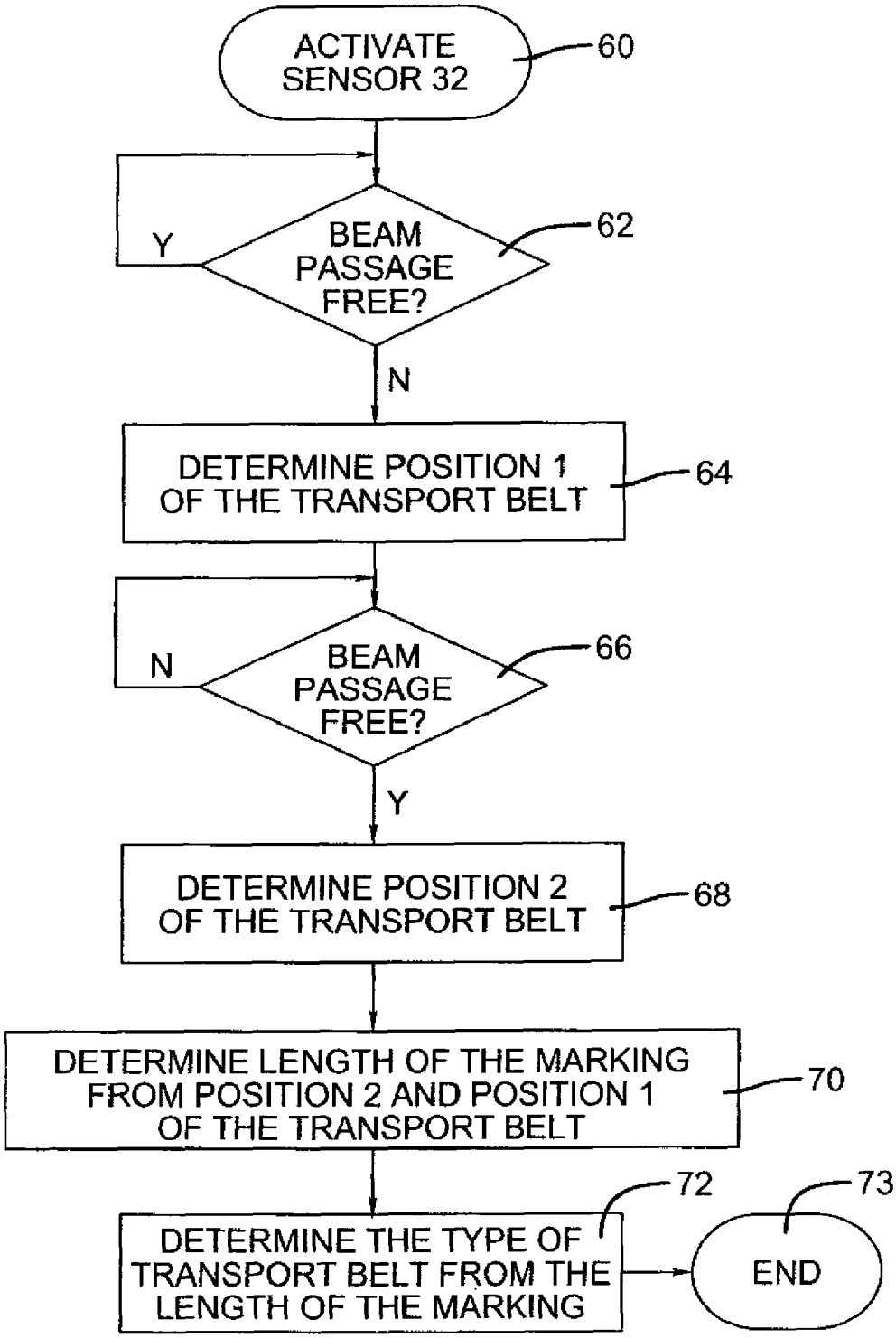
FIG. 5 is a flow chart showing details of detecting, sensing, and allocating, in an embodiment of the method.

With reference to FIG. 5, a method for identifying a transparent conveyor belt, which has an opaque marking according to FIGS. 2 to 4, is shown in greater detail. FIG. 5 is an exemplary flow chart. In block 60, the process is started by the conveyor belt being set in circulatory motion and the sensor 32 being activated.

Next, the process control passes to decision block 62, where a determination is made whether the passage of light through the conveyor belt 12 is free, i.e. whether light passes from the emitter of the sensor 32 through the conveyor belt 12 to the detector. If this is the case, the process continues to pass through the decision block until the passage of light is covered, which indicates that the front edge of the marking 42 has passed into the path of the beam of the sensor 32. At this point in time, a first belt position of the conveyor belt in the direction of travel is determined in block 64 using the angular position sensor 16. Next, the process passes to decision block 66, in which a determination is made whether the passage of light is free. If this is not the case, the process is repeated until the passage of light is free again. At this point in time, the process passes on to block 68, in which a second belt position of the conveyor belt in the direction of travel is now determined using the angular position sensor 16. From the belt positions 1 and 2, the length of the marking is then determined in block 70. In block 72, the type of conveyor belt is then determined in accordance with the length of the marking, for example, by referring to a look-up table, in which different belt types are specified for different marking lengths. Finally, the process passes to block 73, in which the automatic identification process is ended. At this point in time, the process control of the printer applies control parameters for the type of conveyor belt being used in the printer.

Figure 6:
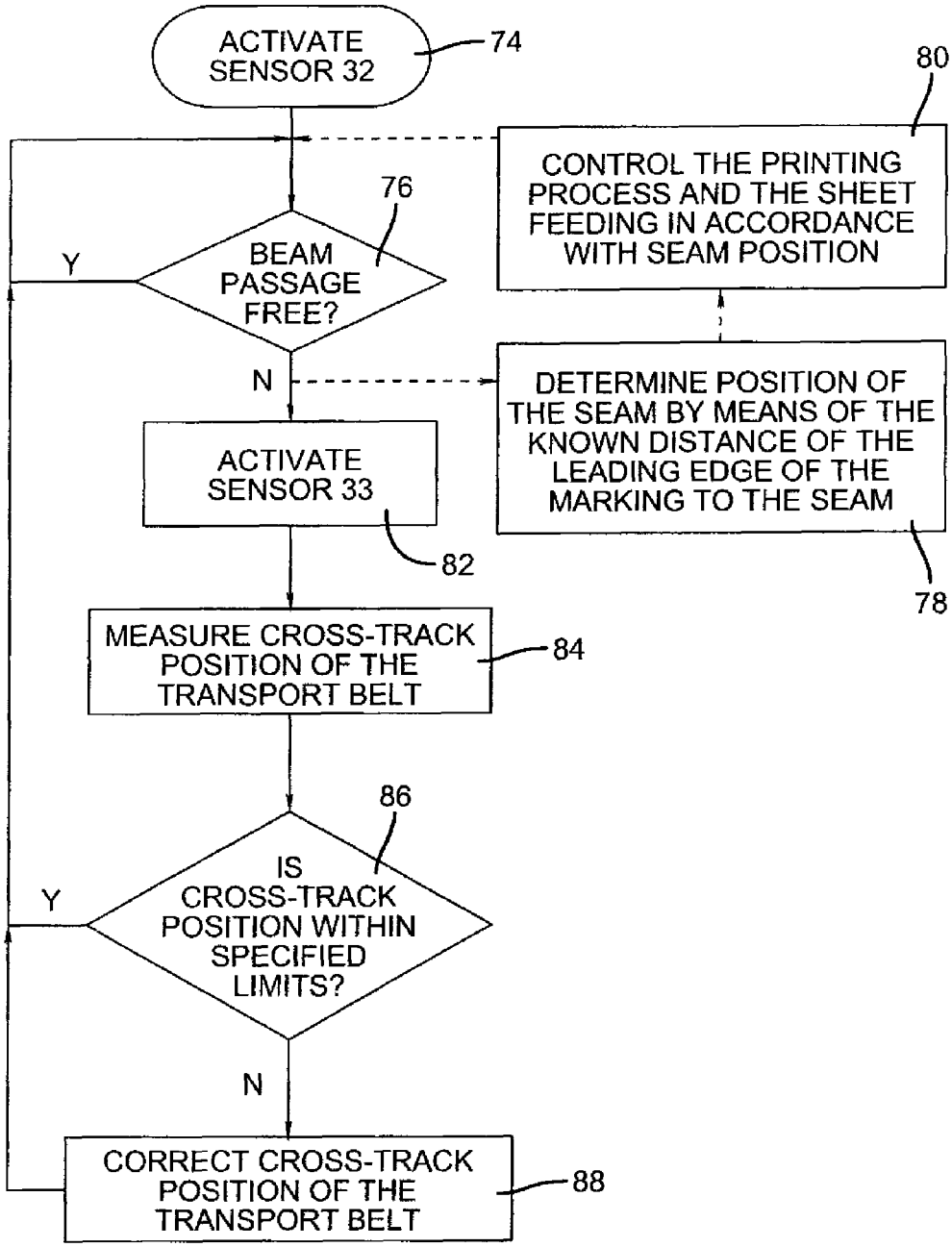
FIG. 6 is a flow chart showing details of optional features of the embodiment of FIG. 5.

In FIG. 6, a process sequence for correcting a cross-track alignment of the conveyor belt and seam identification is shown in greater detail. In block 74, the sensor 32 is activated while the conveyor belt is driven. As described above with respect to decision block 62, in decision block 76 a determination is made whether the passage of light through the conveyor belt 12 is free. The process is continued until a determination is made that the passage of light is blocked, which indicates shadowing of the sensor by the marking 42. The process can then optionally, as shown by the dashed lines, determine the positioning of the seam. In block 78, the position of the seam is determined by means of the known distance between the leading edge of the marking and the seam. Next, in block 80 the printing process and the sheet feeding of the printer are controlled in accordance with the position of the seam, such that no sheets are placed on the seam. The process then passes back to decision block 76.

From decision block 76, the process passes to block 82, after it has been determined that the passage of light is blocked. In block 82, measurement of the cross-track position of the belt is initiated, because, as can be seen in FIG. 2, at this point in time the marking 42 is located in the region of the sensor 33. The corresponding measurement of the cross-track position of the belt is implemented in block 84. In decision block 86, a determination is made whether the cross-track position of the belt lies within pre-specified limits. If this is the case, the process loops back to decision block 76. If the cross-track position of the belt lies outside of the pre-specified limits, the process then passes to block 88, in which the cross-track track position of the belt is corrected. Next, the process loops back to decision block 76. When the whole printing process has ended, the process according to FIG. 6 is also ended.

The process sequence described above for automatically identifying the type of conveyor belt can be automatically implemented each time the printer is re-started or each time the operator is allowed access to the conveyor belt. This can be initiated, for example, by an appropriate signal when opening an access cover, which would enable access to the conveyor belt and thus a change thereof.

The method can be varied as known to those of skill in the art. For example, the above presumes that the conveyor belt has a seam. The method can also be applied to a seamless conveyor belt. The design of the respective sensors can also be changed. The length of the marking can be determined from a known belt circulation speed and the temporal difference in identifying the start and end of the marking.

In the following, an alternative method for automatically identifying a type of conveyor belt, which is moved along a circulatory path within the printer, through at least one printing station. In this method, during an identification mode the conveyor belt is moved past a marking unit, which applies a specific electric charge image (a non-patterned or patterned area of electric charge) to a region of the conveyor belt. The region of the conveyor belt to which the electric charge image has been applied is then moved along the circuit. After a specific time, the charged region of the belt moves past a sensor, which samples the electric charge remaining on the conveyor belt and determines the type of conveyor belt based on the change in the electric charge image.

In electrophotographic printers, it is known to apply an electric charge to the conveyor belt in order to facilitate the transfer of toner to a material to be printed. In this embodiment, different types of conveyor belts have different electrical properties. If the electrical conductivity of the conveyor belt differs with the different types, applying an electric charge and detecting the electric charge at a later point in time, provides an identification of the type of conveyor belt. The value of the detected electric charge is, for example, compared with a look-up table, having values for different types of conveyor belt. In a particular embodiment, the predetermined time between applying the electric charge and detecting the same is determined by a distance covered by the conveyor belt at a pre-specified speed. In a particular embodiment, the electric charge is applied by an impression cylinder of a printing module of an electrophotographic printer. The impression cylinder is in contact with the conveyor belt and supplies an electric charge for facilitating the transfer of toner to the print media during a printing mode of the printer.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular and/or plural in referring to the "method" or "methods" and the like is not limiting.

The invention has been described in detail with particular reference to certain preferred embodiments thereof, but it will be understood that variations and modifications can be effected within the spirit and scope of the invention.

The invention claimed is:

1. A method for automatically identifying a conveyor belt in a printer as being one of a plurality of belt types, the method comprising the steps of:

moving the conveyor belt along a circulatory path within the printer;

detecting a start and detecting an end of a longitudinal marking on said moving conveyor belt;

sensing a distance of travel of said moving conveyor belt between said detecting of said start and said detecting of said end to provide a sensed marking length;

allocating said sensed marking length to a nearest of a plurality of nominal marking lengths, each said nominal marking length being associated with a respective one of said belt types; and wherein each of said belt types is defined by a different set of one or more control parameters and further comprising applying a respective said set of one or more control parameters to the printer responsive to said defining.

2. The method of claim 1 wherein said one or more control parameters control a sheet feed cycle.

3. The method of claim 1 wherein said conveyor belt has a main portion between a pair of opposed, longitudinal edges, said main portion being transparent, said marking being an opaque streak disposed in one of said edges.

4. The method of claim 3 wherein said conveyor belt has a seam at a predetermined separation from said start of said marking and further comprising calculating a position of said seam on said conveyor belt from said detected start.

5. The method of claim 4 wherein said marking extends over said seam.

6. The method of claim 4 wherein said marking is disposed in one of said edges; and further comprising the steps of:

following said detecting of said start of said marking, detecting an alignment indicator disposed in one of said edges;

sensing a offset between said detecting of said start and said detecting of said indicator; and computing a cross-track alignment adjustment of said conveyor belt from said offset.

7. The method of claim 1 wherein said conveyor belt has a seam at a predetermined separation from said start of said marking and further comprising calculating a position of said seam on said conveyor belt from said detected start.

8. The method of claim 7 wherein said marking extends over said seam.

9. The method of claim 7 wherein said predetermined separation is independent of the belt type.

10. The method of claim 1 wherein said conveyor belt has a main portion between a pair of opposed, longitudinal edges and said marking is disposed in one of said edges; and further comprising the steps of:

following said detecting of said start of said marking, detecting an alignment indicator disposed in one of said edges;

sensing a offset between said detecting of said start and said detecting of said indicator; and computing a cross-track alignment of said conveyor belt from said offset.

11. The method of claim 1 further comprising:

restarting the printer following a shut-down; and enabling said detecting, sensing, and determining steps responsive to said restarting.

12. The method of claim 1 further comprising:

generating a belt access signal when an access flap of said printer is moved from a closed position to an open position, said access flap denying operator access to said conveyor belt when said access flap is in said closed position, said access flap allowing operator access to said conveyor belt only when said access flap is in said open position; and enabling said detecting, sensing, and determining steps responsive to said belt access signal.

13. A method for automatically identifying control parameters for a conveyor belt in a printer, the method comprising the steps of:

moving the conveyor belt along a circulatory path within the printer, said conveyor belt having a main portion between a pair of opposed, longitudinal edges, said main portion being transparent;

detecting a start and detecting an end of an opaque, longitudinal streak extending along one of said edges of said moving conveyor belt;

sensing a distance of travel of said moving conveyor belt between said detecting of said start and said detecting of said end to provide a sensed marking length; and allocating said sensed marking length to a nearest of a plurality of nominal marking lengths, each said nominal marking length being associated with a respective one of a plurality of different sets of said control parameters; and applying the determined said set of one or more control parameters to the printer.

14. The method of claim 13 wherein said conveyor belt has a seam at a predetermined separation from said start of said marking and further comprising calculating a position of said seam on said conveyor belt from said detected start.

15. The method of claim 14 wherein said marking extends over said seam.

16. The method of claim 15 further comprising:

following said detecting of said start of said marking, detecting an alignment indicator disposed in one of said edges;

sensing a offset between said detecting of said start and said detecting of said indicator; and computing a cross-track alignment of said conveyor belt from said offset.

17. A method for automatically identifying a conveyor belt in a printer as being one of a plurality of belt types, the method comprising the steps of:

applying an electrical charge image to a portion of said conveyor belt;

moving the conveyor belt along a circulatory path within the printer;

sampling said electrical charge image following said moving;

determining a change in said electrical change image from said sampling and said moving;

determining a respective one of said belt types from said determined change; and wherein said electric charge image is applied by an impression cylinder of a printing module of an electrophotographic printer, which is in contact with the conveyor belt.

18. The method of claim 17 wherein said moving is at a preset speed.

* * * * *